US005638955A

United States Patent [19]

Calciano

[11] Patent Number: 5,638,955

[45] Date of Patent: Jun. 17, 1997

[54] TRANSPORTABLE HOLDER FOR AN ELECTRICALLY POWERED STYLING INSTRUMENT

[76] Inventor: C. Daniel Calciano, 714 Long La., Upper Darby, Pa. 19082

[21] Appl. No.: 548,664

[22] Filed: Oct. 26, 1995

[51] Int. Cl.[6] ..... B65D 81/38

[52] U.S. Cl. ..... 206/320; 206/349; 383/86; 383/110

[58] Field of Search ..... 206/37, 305, 320, 206/349; 219/222, 225, 226; 248/117.1–117.7; 383/86, 110

[56] References Cited

U.S. PATENT DOCUMENTS

| | | | |
|---|---|---|---|
| 2,534,122 | 12/1950 | Hamala | 206/320 |
| 4,570,792 | 2/1986 | Conway | 206/349 |
| 4,658,956 | 4/1987 | Takeda et al. | 206/305 |
| 4,660,610 | 4/1987 | McIntire, III | 206/349 |
| 4,917,239 | 4/1990 | Smith | 206/349 |
| 5,062,529 | 11/1991 | Blair | 206/349 |
| 5,203,456 | 4/1993 | Boswell | 206/349 |

*Primary Examiner*—Jimmy G. Foster
*Attorney, Agent, or Firm*—Paul & Paul

[57] ABSTRACT

A transportable holder for an electrically powered heated styling instrument including an insulated body portion for containing a recently used styling instrument that is still hot, with the walled body portion having insulating properties to prevent heat transmission from the instrument to the exterior of the body portion which may be contacted for handling by an individual. A closure member is also provided to secure the instrument within the holder and cord holding hooks are provided to retain the cord on the holder.

7 Claims, 2 Drawing Sheets

TRANSPORTABLE HOLDER FOR AN ELECTRICALLY POWERED STYLING INSTRUMENT

BACKGROUND OF THE INVENTION

1. Field of Invention

The present apparatus relates to the field of hair styling instruments, and more particularly to holders therefor.

2. Brief Description of the Prior Art

Many instruments are widely used throughout the hair cutting and styling trade. Aside from combs and brushes, many styling instruments include electrically powered devices. Among such devices are blowdryers, and other heating and styling means such as curling irons, hot combs, and the like. In many instances these devices generate a substantial amount of heat during their use and even for a prolonged period of time after use, even when the device is turned off. These devices must therefore be set aside after use when they are hot, thereby posing a potential danger to anyone who would accidentally come into contact with the hot styling instrument.

While barbers, hairstylists and beauticians are careful to maintain these instruments away from themselves and their customers, and others who may walk by the area in which these devices are used, the exposed electrically heated device, such as, for example, a curling iron, still poses a danger in the work area. In some instances, these devices come with collapsible support means to permit the device to rest slightly away from a countertop or other surface. However, although the device may then not be hazardous to a countertop or other items, it is still hot for some time after it is used and remains a potential hazard for those who would accidently come into contact with its hot surfaces. Further adding to the danger is that many of these electrically powered appliances have cords which may also get tangled or disrupted by those passing by or in close proximity to the device. For example, when a curling iron has just been used, the general practice is to set it on a counter with the hot part raised slightly off of the counter surface. Since the device remains hot for sometime after use, it cannot be simply put away in a drawer or cabinet space. In addition, the device, such as for example, a curling iron, may not be readily transportable immediately after use because of the heat of its surfaces.

While the stands provided for electrically powered heated appliances used in the beauty and styling trades may have means to prevent a countertop from burning, such as the curling iron stand mentioned above, there exists a need for a device which would prevent injuries, namely burns, caused from accidently knocking or bumping into the curling iron or cord thereof, and enabling such a heated styling instrument to be immediately portable after use.

SUMMARY OF THE INVENTION

The present invention provides a removable heat insulating/absorbing protective holder to safely store an electrically powered heated styling device, such as, for example, a curling iron, after the device has been used and while the device is still hot. With the holder of the present invention, injuries which might otherwise occur due to coming in contact with the hot surface of the curling iron are prevented when the holder is placed on the curling iron or other heated device. The protective holder also provides cord containing and coiling means which permit total storage of the device by allowing the cord to be coiled around a pair of hooks.

It is an object of the present invention to provide a novel holder which insulates the heat from an electrically powered heated styling instrument after use of the instrument to permit safe storage of the device by preventing contact with the hot surface of the device after it has just been used.

It is another object of the present invention to provide a holder which permits a curling iron or other electrically powered heated styling instruments while still hot, to be readily transportable immediately after use.

It is another object of the present invention to provide a holder which is comprised of a heat resistant or material which can absorb or insulate the heat from the curling iron and be cool enough to handled.

It is a further object of the present invention to provide a holder having means for taking up and holding the cord of the electrically powered device.

Another object of the present invention is to provide means for holding the cord of the electrically powered device wherein the holding means comprises a pair of hooks about which the cord may be coiled.

Additional objects and advantages of the present invention will be recognizable to one of ordinary skill in the art by reading the detailed description of the drawings and the claims appended hereto.

BRIEF DESCRIPTION OF THE DRAWING FIGURES

DETAILED DESCRIPTION OF THE PREFERRED EMBODIMENTS

Figure 1:
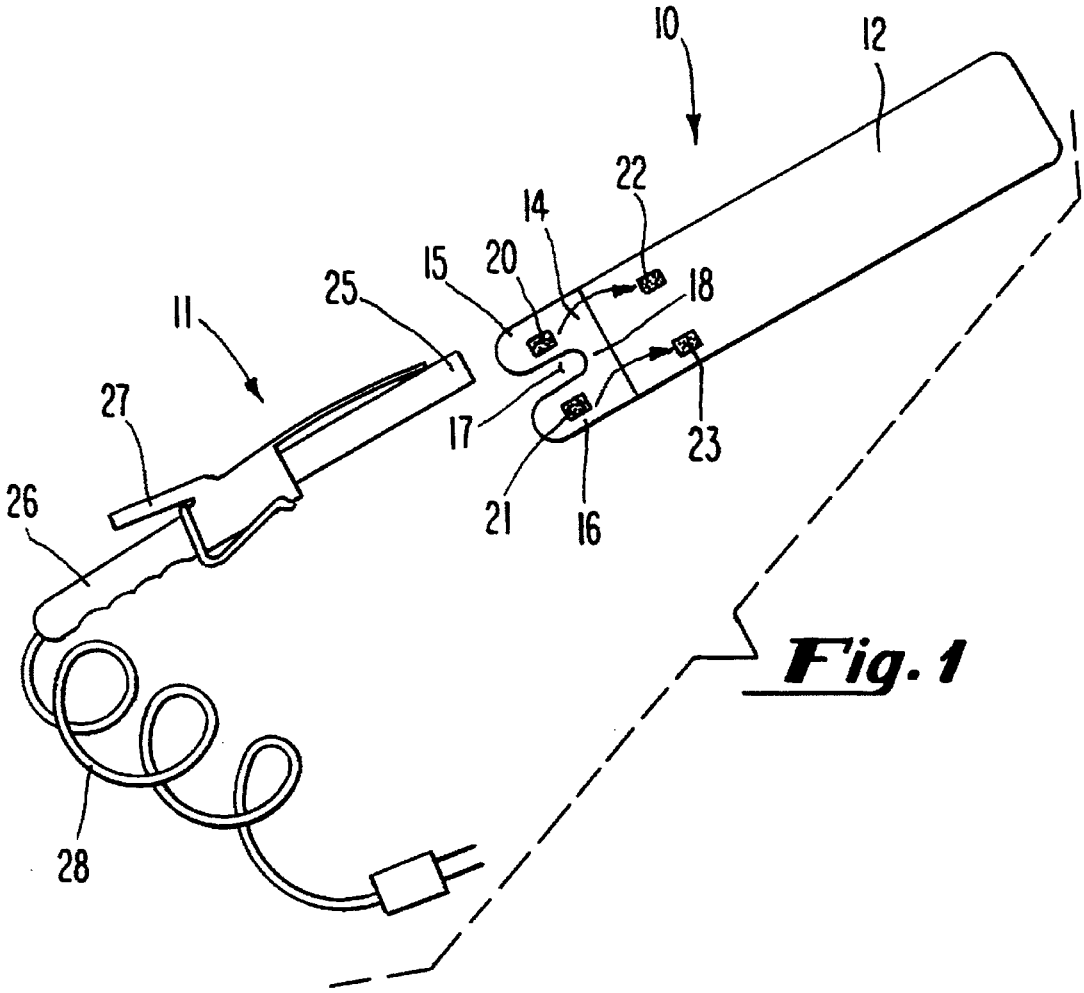
FIG. 1 is a side perspective view of a curling iron and the holder of the present invention shown in position to receive the curling iron within its pocket.

Referring now to FIG. 1, the holder 10 for an electrically powered heated styling instrument is shown comprising a body portion 12 which encloses a hollow space or pocket 13 (FIG. 3) within which the electrically powered heated styling device, such as the curling iron 11, can be stored after use. The holder 10 is also provided with a closure member 14 at one end of the body portion 12 having a pair of flaps 15 and 16 which are separated by a groove or notch 17 disposed therebetween. The flaps 15 and 16 also comprise a meeting portion 18 which is located below the groove 17.

Figure 4:
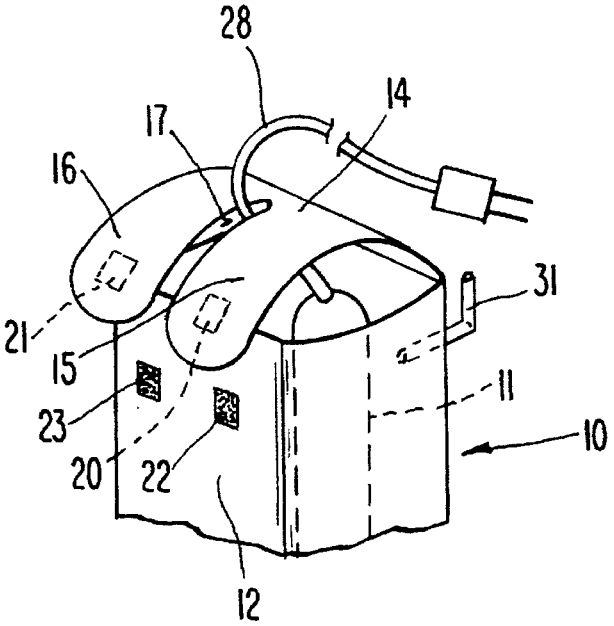
FIG. 4 is a partial right perspective view of the upper portion of the curling iron holder showing the securing means which retain the curling iron within the holder pocket.

Suitable securing means are provided for securing the closure member 14 onto the body portion 12. These securing means may comprise any such suitable means which allow attachment and detachment of the closure flaps 15 and 16 to and from the body portion 12. Preferably, as shown in FIGS. 1 and 4, a surface of hooks and matingly associated attaching pile surface, such as, for example, velcro® material, may be used such that the closure flaps contain one portion of the velcro® connector 20 and 21 and the body portion contains the other of a portion of mating velcro® surfaces, respectively 22 and 23. This permits easy closing and opening of the closure member 14 in relation with the body portion 12.

The securing means, while shown as velcro® components 20, 21, 22 and 23, may also comprise snaps, magnetic means, or any other like suitable fastening members. The curling iron 11 is shown as an example of the type of electrically powered heated styling devices which may be safely stored with the holder of the present invention. The curling iron 11 is shown having a tubular end portion 25, a handle 26, an operating lever 27, and a power cord 28. The tubular end portion 25 contains a heating element (not shown) which remains hot during and for a period of time after use. If left exposed, the end portion 25, wherein hot, presents a potential hazard for anyone encountering the device 11.

The holder 10 is shown in FIG. 4 with the curling iron 11 contained therein within the pocket 13 formed by the body portion 12. The cord 28 of the curling iron 11 is shown extending through the groove 17 adjacent the closure flaps 15. The cord 28 extends over the closure member 14 and is held in place with securing means provided on the back of the body portion 12 of the holder 10. The securing means are shown comprising a pair of hooks 31 and 32 which are secured to the body portion 12 at one end thereof and extend outwardly therefrom. The hooks 31 and 32 are preferably L-shaped members which extend in opposite outwardly directions from one another to facilitate the securing of the cord thereabout. The outwardly extending portions 33 and 34 of the respective hooks 31 and 32 provide a ledge to maintain the cord against slippage or unraveling.

Figure 2:
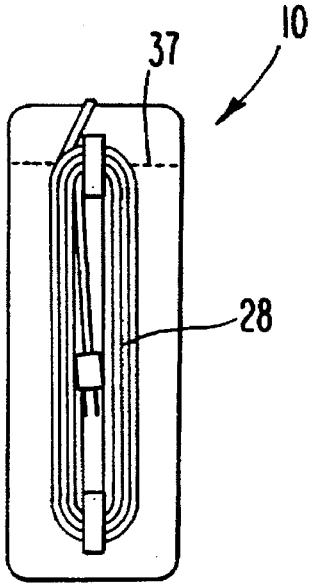
FIG. 2 is a rear elevation view of the holder of the present invention with the curling iron enclosed therein showing the cord holding means retaining the cord in position.

The body portion 12 may comprise a single layer, or preferably as shown, may comprise an outer cover portion 35 and an inner cover portion 36. The inner cover portion 36 preferably comprises a material which will insulate heat from passing through its outermost edge and thereby permit the cover to be picked up and handled when there is a curling iron 11 inside which is still hot from having been used. The outer cover portion 35 may comprise any suitable material for adding support to the heat resistant inner cover portion 36, or may comprise additional heat resistant heat insulating material. The outer cover portion 35 preferably may comprise nylon or leather or any other suitable material which can be flexible to conform to the shape of the appliance, such as the curling iron 11, or a variation of that or another appliance, which may be a different model requiring different holder dimensions. Therefore, the inner and outer cover portions 35 and 36, respectively, are flexibly provided in order to accommodate the curling iron 11. In addition, the closure member 14 can comprise the material of the outer cover portion 35 and furthermore may be reinforced at the back of the holder 10 as shown in FIG. 2 with any suitable reinforcement means, such as the enhanced stitching 37 shown in FIG. 2.

Figure 3:
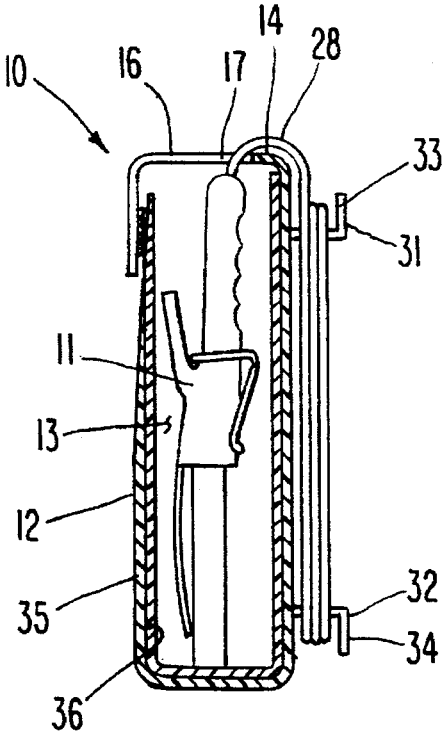
FIG. 3 is a right sectional view of the curling iron holder shown with a curling iron contained within the pocket of the holder, and the cord being secured with the cord holding means.

Referring to FIG. 4, a perspective view of the closure member 14 with the closure flaps 15 and 16 shown coming into position over the top of the curling iron 11 to secure the closure member 14 to the front of the body portion 12 of the holder 10. Also, in FIG. 2, the securing means, preferably shown comprising velcro components 20, 21, 22, 23, is shown as a means to attach and detach the closure member 14 to permit insertion and removal of the curling iron 11 or other electrically powered heated styling instrument which is to be contained within the holder 10. The cord 28 of the curling iron 11 is shown extending through the groove 17 defined between the closure flaps 15 and 16. This permits the cord 28 to be safely and securely coiled for storage about the hooks 31 and 32, as shown in FIGS. 2 and 3.

While not shown, the body portion 12 of the holder 10 may comprise a single material or multi-layered material that is suitable for withstanding the heat of a recently used electrically powered heated styling instrument, such as a curling iron 11, blowdryer, hot comb, or the like (not shown), and preventing the heat, whether by insulation or dissipation or absorption, from being transmitted to the exterior surface of the body portion 12, so that a user may handle, transport or otherwise move or store the device, such as the curling iron 11, within the holder 10 by touching the holder 10.

The curling iron, while described as an electrically powered device may be powered by an alternate source such as battery power or solar power, or other suitable powering means, consistent with the scope of the invention described herein. Also while not shown, a suitable handle for carrying the holder 10 may be provided for facilitating transport and storage of said holder 10 and the styling instrument.

Other modifications consistent with the scope of the invention discussed above and as recited in the appended claims attached hereto may be made, as one of ordinary skill in the art will realize.

I claim:

1. A holder for an electrically powered heated styling instrument comprising:

a) a walled body portion defining a space therein, with an opening therein to permit access to said body space for storage and retrieval of an instrument to be held therein; and b) a closure member extending from the walled body portion proximate to said body opening for removably covering said body opening;

c) wherein said walled body portion comprises one or more of a heat insulating material and a heat absorbing material to maintain the outer wall from significant heat transference from said instrument; and d) wherein said instrument includes a power cord and wherein said closure comprises a pair of flaps defining a groove therebetween for accommodating a cord of said instrument.

2. The holder of claim 1, further including securing means for securing and detaching said closure member from said body portion, such that when the securing means are secured the closure member covers said body opening at least in part and that when said closure member is detached said body space is accessible.

3. The apparatus of claim 2 wherein said securing means are provided on said walled body portion and said closure member for selective attachment of said body portion and said closure member to one another and selective detachment therefrom.

4. The holder of claim 1, wherein said instrument includes a power cord, and wherein said holder further comprises cord holding means.

5. The holder of claim 4, wherein said cord holding means comprises a pair of L-shaped hooks attached to said walled body portion and extending outwardly therefrom.

6. The holder of claim 5, further comprising a handle attached to said body portion for facilitating transport of said holder and any instrument contained therein.

7. A holder for an electrically powered heated styling instrument comprising:

a) a walled body portion having a hollow space therein, said walled body portion comprising an interior wall defining said hollow space and an exterior wall surrounding said interior wall;

b) said body portion having at least one opening therein for access to said hollow space to permit storage of said instrument therein;

c) wherein said interior wall comprises a material which will substantially prevent heat transference therethrough in relation to said exterior wall;

d) a closure member having at least one free end and another end which is fixedly attached to said body portion proximate to said body opening, said closure member being flexibly provided to be movable over said body opening to cover said body opening and movable away from said body opening to permit access to said body opening;

e) said closure member including securing means for selectively attaching the closure member to said body portion to secure the closure member over said body opening and selectively detaching said closure member from said body portion to expose said body opening and permit access thereto;

f) said closure member further including a groove disposed therein for accommodating a power cord of said instrument when said closure member is attached to said body portion;

g) cord holding means for retaining the cord of said instrument, said cord holding means comprising a pair of L-shaped hooks attached to and extending from said body portion, said hooks each having a horizontally extending portion and a vertically extending portion connected thereto, said vertically extending portion of each said hook being outwardly extending in relation to said other hook; and h) wherein said closure member securing means comprise a surface of hooks and a second surface of pile wherein one of said first surface and said second surface is provided on said body portion and the other of said first surface and said second surface is provided on said closure member, wherein said first and second surfaces are matingly associated for selective attachment and detachment from one another.

* * * * *